US007629022B2

(12) United States Patent
Mase et al.

(10) Patent No.: US 7,629,022 B2
(45) Date of Patent: Dec. 8, 2009

(54) METHOD FOR FORMING A LAYER OF FLAKY PARTICLES

(75) Inventors: Keiji Mase, Tokyo (JP); Shozo Ishibashi, Tokyo (JP)

(73) Assignee: Fuji Manufacturing Co., Ltd., Tokyo (JP)

( * ) Notice: Subject to any disclaimer, the term of this patent is extended or adjusted under 35 U.S.C. 154(b) by 64 days.

(21) Appl. No.: 11/174,317

(22) Filed: Jun. 30, 2005

(65) Prior Publication Data

US 2005/0244575 A1 Nov. 3, 2005

(51) Int. Cl.
*B05D 1/12* (2006.01)

(52) U.S. Cl. ..... 427/189; 427/190; 427/202

(58) Field of Classification Search ..... 427/189, 427/190, 202

See application file for complete search history.

(56) References Cited

U.S. PATENT DOCUMENTS 3,100,724 A * 8/1963 Rocheville ..... 118/308
3,390,080 A * 6/1968 Groszek ..... 508/167

FOREIGN PATENT DOCUMENTS

JP 11-131257 * 5/1999
JP 2001-226612 8/2001

OTHER PUBLICATIONS

IMAST 2000#2.*

* cited by examiner

*Primary Examiner*—Frederick J Parker
(74) *Attorney, Agent, or Firm*—Merchant & Gould P.C.

(57) ABSTRACT

Flaky particles whose thickness is ½ or less of a long side of a flat surface thereof are continuously injected together with a compressed gas onto a layer-forming surface of a workpiece to orient the flaky particles so that its flat surface is in line with the surface of the workpiece. By coating a binder to the surface of the workpiece in advance, a bonding between the flake particle thus oriented and the workpiece may be accomplished via this binder, or by generating heat at a point of collision between the surface of the workpiece and the flaky particle and at a collision point in which the subsequent flaky particles collide with the flaky particles that have already reached the surface of the workpiece, the bonding may be accomplished by means of this heat.

2 Claims, No Drawings

METHOD FOR FORMING A LAYER OF FLAKY PARTICLES

BACKGROUND OF THE INVENTION

1. Field of the Invention

The present invention relates to an orientation method for a flaky particle and a method for forming a layer of flaky particles, and more particularly to a method of orienting flaky particles so that a flat surface thereof is parallel with a surface of a workpiece and a method of forming a layer on a surface of the workpiece using the flaky particles oriented with the above-mentioned method.

2. Description of the Prior Art

Conventionally, as a method of attaching the flaky particles to a surface of the workpiece in a predetermined orientation, there is known the method of coating a coating material or the like, which is obtained by causing thin-flake-like flaky particles or scale-flake-like flaky particles to be contained in a coat-forming resin. For example, as a method of providing a mirror-like metallic appearance for the workpiece, there is the method of coating a surface of the workpiece with a coat-forming resin containing minute metallic foil which is obtained by grinding a metallic vapor-deposited layer into minute foil pieces (refer to Japanese Patent Application Laid-open No. 2001-226612 (pp. 2-7)).

Coating the surface of the workpiece with the coating material including the coat-forming resin containing the minute metallic foil in this manner allows the metallic foil in the coating material to be arranged in a predetermined orientation in the coat-forming resin, thus making it possible to obtain a uniform, and mirror-like metallic luster surface without remaining particle shapes.

In the method for forming the layer, since the minute metallic foil contained in the coat-forming resin is arranged in a predetermined orientation in the layer as described before, a mirror-like luster surface can be formed.

With the above-mentioned method, however, although the flaky particle is effective in a process intended for a dressing effect which brings the surface of the workpiece to a mirror-like metallic appearance as described above because the flaky particles are attached to the surface of the workpiece in a state of being buried in the coat-forming resin, for example, the processing of attaching the flaky particles composed of a conductive material to a surface of the workpiece, thereby to render it electrically conductive, or the processing of attaching the flaky particles composed of a solid lubricant such as a molybdenum disulfide or graphite to a sliding portion of a mechanical part, being a workpiece, thereby to improve lubricativeness cannot be carried out.

In a case an attempt is made to attach the flaky particles in a state where they are exposed to an outermost surface of the processed product to be coat-treated, a possible method is that a resin as a binder is coated to a processing surface of the workpiece in advance to attach the flaky particles as described above hereto before hardening of this binder. However, when the flaky particles are attached with this method, unless the flaky particles are supplied so that they come into a predetermined orientation, the orientation of the flaky particles is not unified. If an attempt is made to orient the flaky particles, which were attached to the processing surface with its orientation not unified, in a predetermined direction, for example, to orient the flaky particles so that the flat surface thereof is parallel with the surface of the workpiece, the operation of pressing the attached flaky particles in the predetermined direction or the like is required before hardening of the binder after attachment of the flaky particles.

Further, an organic solvent is generally used as a solvent for the coat-forming resin serving as a binder to attach the flaky particles to the workpiece. After coating such a coat-forming resin to the surface of the workpiece, in order to harden the coat-forming resin, it is necessary to dry the resin to vaporize the organic solvent, which may contaminate working and surrounding environments.

If an attempt is made to avoid such contamination, it is necessary to provide equipment or the like to collect the organic solvent that vaporizes during drying and this will force a heavy burden for equipment investment. Besides, because the step of coating the coat-forming resin to the workpiece and drying it after the coating as described above is necessitated, such layer formation requires going through many working processes.

Further, when such a coat-forming resin is used, it takes a long time to form the layer. For this reason, there is a strong demand for the method that allows the flaky particles to be attached to the surface of the workpiece without the aid of such a coat-forming resin.

Thus, the present invention has been developed to eliminate the disadvantages in the prior art and has objects to provide an orientation method for the flaky particle which enables the flaky particles to be oriented in a predetermined direction with respect to a surface of the workpiece in a relatively simple way, and to provide a method of forming a layer using the flaky particles with such orientation.

Another object of the present invention is to provide a method for forming the layer of the flaky particles, which does not require use of the organic solvent or the like and is therefore environment-friendly, by providing a method of attaching the flaky particles, without the aid of the binder or the like, to the surface of the workpiece in a predetermined orientation for layer formation.

SUMMARY OF THE INVENTION

In order to achieve the above-mentioned objects, an orientation method for a flaky particle according to the present invention includes the steps of continuously injecting the flaky particles, whose thickness is ½ or less of a long side of a flat surface thereof, together with a compressed gas onto a surface of a workpiece, and orienting the flaky particles so that its flat surface is in line with the surface of the workpiece.

Further, a method for forming a layer of flaky particles according to the present invention includes the step of orienting the flaky particles on the surface of the workpiece coated with a binder with the above-mentioned method, thereby to form a layer before hardening the binder.

Moreover, another method for forming a layer of flaky particles according to the present invention includes the steps of continuously injecting the flaky particles, whose thickness is ½ or less of a long side of a flat surface thereof, together with a compressed gas onto a layer-forming surface of a workpiece, orienting the flaky particles so that its flat surface is in line with the surface of the workpiece, generating heat at a point of collision between the surface of the workpiece and the flaky particle and at a collision point in which the subsequent flaky particles collide with the flaky particles that have already reached the surface of the workpiece, and attaching the flaky particles to the surface of the workpiece in the above-mentioned orientation condition.

In the method for forming a layer of the flaky particles, the flaky particles are preferably injected with the compressed gas having a flow velocity of 150 m/s or more, or an injection pressure of 0.4 MPa or more.

Further, the flaky particle preferably includes a flat surface whose long side is 0.1 mm to 0.001 mm in length.

According to the configuration of the present invention including the above-described configuration, the extremely simple operation of injecting the flaky particles together with the compressed gas allows the flaky particles to be oriented in a predetermined direction with respect to the layer-forming surface of the workpiece.

Consequently, coating the binder or the like in advance to the layer-forming surface of the workpiece and injecting the flaky particles onto the coated surface before hardening the binder allows the flaky particle to be attached in a predetermined orientation via the binder, thereby making it possible to form a layer having the flaky particles oriented in a predetermined direction extremely easily.

Further, attaching the flaky particles to the surface of the workpiece in the predetermined orientation by means of heat generated at a point of collision between the surface of the workpiece and the flaky particle as well as at a collision point in which the subsequent flake particles collide with the flaky particles which have already reached the surface of the workpiece by injecting the flaky particles together with the compressed gas onto the layer-forming surface of the workpiece makes it is possible to form a layer without the binder or the like using the organic solvent, accordingly to prevent any contamination of working and surrounding environments due to vaporization of the organic solvent, further to omit an application process, a drying process or the like of the binder, and to improve working efficiency.

In addition, the layer of the flaky particle formed with either method described above, which is different from the layer formed by the conventional technology in which the flaky particles are buried in the coat-forming resin serving as a binder, can have the flaky particles exposed on the outermost surface of the processed workpiece. Accordingly, the effect of forming a conductive layer on a surface of an insulating workpiece by use of the conductive flaky particles, forming a lubricative layer on a surface of a workpiece by use of the flaky particles including solid lubricant, or the like, which has never been achieved by the conventional technology, can be achieved.

DETAILED DESCRIPTION OF PREFERRED EMBODIMENTS

Next, preferred embodiments of the present invention will be described below.

[Orientation Method]

The orientation method for the flaky particle according to the present invention is a method of orienting the flaky particles on a surface of the workpiece in a predetermined direction by spraying the flaky particles on the surface of the workpiece together with the compressed air.

Additionally, the so-called flaky particle in the present invention extensively covers a flaky particle having a flat surface which is of scale shape, flake shape, or the like, and has a thickness which is ½ or less of a diameter or a side forming the flat surface, which is longer (referred to herein as a "long side" in this specification).

Injection of the flaky particles may be performed using any equipment provided that it is capable of injecting the flaky particles to be later described together with the compressed gas. Known air-type blast processing equipment in general can be used for the method of the present invention.

Further, when the injection of the flaky particles is performed using such air-type blast processing equipment, the shape or the like of an injection nozzle provided in the blast processing equipment is not particularly limited if it is capable of injecting the flaky particles, and known various types such as a round type and a slit type can be used as they stand.

The injection of the flake particles can be accomplished by the blast processing equipment. If the equipment is capable of making the flaky particles collide with the workpiece, the size and material of the flaky particle, the material and shape of the workpiece, the flow velocity and injection pressure of the compressed gas, and so on can be set as appropriate. As one example, when the flaky particle is aluminum, the injection is performed by means of the compressed gas having a flow velocity of 150 to 310 m/s or an injection pressure of 0.4 to 0.7 MPa with a long side forming a flat surface assumed to be 0.05 mm to 0.01 mm in length.

When the flaky particles are injected together with the compressed gas in this manner, the injected flaky particles collide with the workpiece while spinning in a turbulent gas. For this reason, at the moment that the flaky particles collide with the surface of the workpiece, each of them does not collide therewith in a predetermined direction but collides therewith in different directions.

However, the flaky particles, which are continuously injected from the injection nozzle and subsequently reach the surface of the workpiece, collide with flaky particles having already reached the surface of the workpiece, to which pressure of the compressed gas to inject the flaky particles is also applied. Accordingly, the flat surface is oriented to be in line with the surface of the workpiece.

Consequently, injecting the flaky particles onto the layer-forming surface of the workpiece in this manner enables the injected flaky particles to be oriented in the predetermined direction.

[Method for Forming a Layer]

As described above, according to the above orientation method for the flaky particle, the flaky particles can be oriented in a predetermined direction with respect to the surface of the workpiece. It is thus possible to form a layer composed of the flaky particles by use of such an orientation method.

Methods of forming a layer composed of the flaky particles using such an orientation method will be described below.

(1) Method for Forming a Layer by Using a Binder

In this embodiment, the binder is used to attach the flaky particles to a surface of the workpiece, and the layer composed of the flaky particles is formed on the surface of the workpiece by interposing this binder.

In this method, the binder is coated in advance to an area of the surface of the workpiece, in which the layer composed of the flaky particles is to be formed and the flaky particles are injected together with the compressed air, thereby to form the layer before hardening of this binder.

When the flaky particles are injected toward the binder-coated surface of the workpiece in this manner, the injected flaky particles each collide with and become attached to the surface of the workpiece in different directions while spinning in the turbulent gas as described above.

However, the flaky particles thus attached to the surface of the workpiece are oriented so that the flat surface thereof is in line with the surface of the workpiece by collision by the flaky particles, which are continuously injected from the injection nozzle and subsequently reach the workpiece, and by the pressure of the compressed gas to blow this flaky particles. Consequently, the flaky particles injected together with the compressed gas can be attached to the surface of the workpiece via the binder in a predetermined orientation and yet in a uniform condition.

Thus, attaching the flaky particles to the surface of the workpiece in a predetermined orientation and then drying the binder to bond the workpiece and the flake particle for hardening allows a stable layer of the flaky particles to be formed.

In the method for forming the layer of the flaky particles in accordance with the above-mentioned method, since the bonding between the workpiece and the flake particle is performed via the binder, the materials of the workpiece to be processed and the flaky particle are not particularly limited, and for both the workpiece and the flaky particle, various materials, for instance, wood, resin such as a plastic product, mineral such as stone, and a plant material such as wood can be used in addition to metal, glass, ceramics or the like.

(2) Method for Forming a Layer by Using Collision Energy

In the above-mentioned embodiment, the binder is used to attach the flaky particles to the surface of the workpiece, but in the method indicated in this embodiment, the flaky particles are attached directly to the surface of the workpiece, thereby to form a layer without use of the binder or the like.

In the formation of the layer with this method, the heat, which, at the moment that the flaky particles injected together with the compressed gas collide with the surface of the workpiece, is generated at this collision point, and the heat, which, at the moment that the subsequent flaky particles that are about to collide with the surface of the workpiece collide with the flaky particles that have already reached the workpiece, is generated at this collision point, cause the flaky particles to be attached to the surface of the workpiece.

The heat generated by such injection of the flaky particles reaches, in a theoretical analysis, a maximum value of 1500 K in 0.1 μs after collision and therefore a surface temperature of the workpiece rises instantaneously. And the heat thus generated gives rise to a bonding between the flaky particle and the workpiece as described above.

The heat thus generated is rapidly cooled so that the temperature is decreased. However, the flaky particles injected from the injection nozzle continuously collide with the surface of the workpiece and the flaky particles attached to this surface, whereby a required amount of heat to give rise to a continuous bonding between the workpiece and the flaky particle can be ensured.

The attachment due to heat generation in the present invention seems to be effected by melting of the workpiece and/or the flaky particle at a point of collision due to the heat generated at the time of collision and by resultant fusion of both materials at a boundary portion. This is because the complete melting causes the flake shape to be completely lost and a different crystal structure to be produced, resulting in collapsing in orientation.

Furthermore, as another fusion mechanism in the present invention, it is assumed that mechanical energy due to collision causes a part of the flaky particles to be buried in the workpiece and the heat generated at the time of collision melts the flake substance and the workpiece to be completely fused at a boundary portion thereof.

In addition, any physical or chemical bonding, which enables the flaky particles to be attached to the workpiece, is permitted.

A specific gravity of the particle, a diameter of the particle, and a velocity or, an injection pressure of the injected gas determine the combination of the material of the workpiece and that of the flaky particle.

Further, in order to ensure collision energy to generate heat to give rise to the bonding between the flake particle and the workpiece as described above, the size of the flake particle is preferably about 0.1 mm to 0.001 mm at its long side and the compressed gas to inject the flaky particles preferably has a flow velocity of 150 m/s or more or an injection pressure of 0.4 MPa or more.

[Flaky Particle]

As an example, when the flaky particle is intended to provide the workpiece with a metallic appearance, flaky particles can be used, which include various kinds of metal such as aluminum (Al), silicon (Si), titanium (Ti), vanadium (V), chromium (Cr), manganese (Mn), iron (Fe), cobalt (Co), nickel (Ni), copper (Cu), zinc (Zn), germanium (Ge), zirconium (Zr), neodymium (Nd), molybdenum (Mo), rhodium (Rh), palladium (Pd), silver (Ag), indium (In), tin (Sn), platinum (Pt), or gold (Au) and oxides of the above-mentioned metal, oxides of two or more metals mentioned above, and an amorphous structure. These metals can also be used for formation of a protective or conductive layer depending upon the properties. Further, when the flaky particle is intended for formation of a heat-resistant or wear-resistant layer, the one made of ceramics or the like can be used. When the flaky particle is intended to form a lubricative layer on a sliding portion of a mechanical part or the like, the one comprising a solid lubricant such as molybdenum disulfide, graphite, boron nitride, tungsten disulfide, hydrated aluminum silicate, mica represented by potassium, talc represented by hydrated magnesium silicate, or kaolin represented by hydrated aluminum silicate can be used. As a way to chemically change and beautify a surface of a substrate, the flaky particle made of an aluminum solid solution iron oxide $\alpha$-$Fe_2O_3$ (for example, iron oxide pearl pigment produced by TITAN KOGYO K.K.), scale, or shell can be used. When the flaky particle is intended for formation of a magnetic layer, the one made of a magnetic material such as a barium ferrite or iron oxide can be used. When the flaky particle is intended for insulation or heat resistance, a mineral one made of mica or the like can be used. To form a protective layer intended for water resistance, weather resistance, soil resistance or the like, a flaky particle made of various resin materials can be used. Namely, the type of the flaky particle can be selected in accordance with the purpose and application thereof.

If the flaky particle is a mineral one, it is possible to cleave the particle on the basis of a crystal structure thereof to break the particle in a flake shape by, for instance, running it through a grinding machine. Also, the flaky particle can be obtained by producing a membrane, foil, plate, or layer or the like having a thickness, which allows a desired flake ratio to be provided, by means of an appropriate method, for instance, vapor deposition or rolling for the metallic flaky particle, firing to a predetermined thickness for the ceramic one, and drawing, inflation, or the like for the resin one, and then grinding or cutting it.

In addition, the size of the flaky particle is not particularly limited if it permits injection with the compressed gas by the known blast processing equipment. However, when the flaky particle is used in the method of bonding the workpiece and the flaky fluid by means of the heat generated due to collision with the workpiece as stated above or the like, the length of the long side of the flaky particle to achieve heat generation to give rise to such bonding is preferably 0.1 mm to 0.001 mm, and more preferably 0.01 mm to 0.001 mm.

EXAMPLE

TABLE 1

| | |
|---|---|
| Blast processing Equipment | SCM-4 with fine abrasive material feeder (manufactured by Fuji Manufacturing Co., Ltd.) |
| Injection gun | F2-2 (manufactured by Fuji Manufacturing Co., Ltd.) |
| Work piece | Aluminum, 100 mm × 100 mm × 2 mm (thickness) |
| Emission pressure | 0.5 Mpa |
| Injection distance | 85 mm |
| Injection speed | 200 m/s |

1. Example

Flaky particle: Ba ferrite (BF-2700, produced by TITAN KOGYO K.K.)

Crystal system: Hexagonal

Shape and crystal face: It is of hexagonal plate shape and its flaky crystal face is surface c.

Long side diameter of flaky crystal: 1 μm, thickness: 0.3 μm An easy magnetization axis of the Ba ferrite is axis c.

The magnetic property of the particle and the magnetic property after injection of the particle onto the workpiece were measured by a vibrating sample magnetometer (VSM). The maximum applied magnetic field is 1200 kA/m. Magnetic measurements of the particle were made with a sample holder filled with the particles, while measurements of the layer on the workpiece after the injection processing were made with two stacked 5 mm by 5 mm samples cut from the workpiece set in the sample holder so as to be perpendicular to an applied magnetic field.

TABLE 2

| | Magnetic property of grain | Magnetic property after injection processing |
|---|---|---|
| Saturated magnetization (Standard value) | 1.0 | 1.0 |
| Squareness ratio | 0.49 | 0.7 |

From the hysteresis curve of the sample for the VSM, the squareness ratio is determined by a ratio of saturated magnetization σs to remanent magnetization σr, which is expressed by σr/σs.

The result demonstrates that the squareness ratio in a granular state is magnetically isotropic and the arrangement of the particle is also isotropic. The squareness ratio after the injection processing is 0.75, which shows magnetic orientation. The plate-like face of the plate-like Ba ferrite is surface c and axis c, being its crystal axis, is an easy magnetization axis. That is, the crystal after the injection processing shows that the flaky face is arranged in parallel with the surface of the workpiece.

2. As a comparative example, the magnetic particle $\gamma$-$Fe_2O_3$, being a needle-like particle, was similarly subjected to the injection processing. The squareness ratio after the injection is 0.5 and the particle is not oriented magnetically. This shows that the injection-processed layer is not oriented.

The above described methods according to the present invention are applicable in a wide range of technical fields; for example, they can be used to form a layer intended for a dressing effect such as providing a surface of the workpiece of various materials with a metallic luster or processing it to a mirror-finished surface as well as to form a protective layer, a conductive layer, a lubricative layer, or the like.

Thus, the broadest claims that follow are not directed to a machine that is configuration a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation as to protect the heart of this invention, as a matter of law.

It will thus be seen that the objects set forth above, and those made apparent from the foregoing description, are efficiently attained. Also, since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described;

What is claimed is:

1. A method for forming a layer of flaky particles, comprising the steps of:

preparing flaky particles whose long side is 0.1 mm to 0.001 mm in length and whose thickness is ½ or less of the long side of a flat surface thereof by breaking or grinding or cutting materials to be injected in a flake shape allowing to ensure collision energy to generate heat to give rise to fusion between the flaky particles and the workpiece by collision of the flaky particles to be injected to the workpiece;

continuously injecting the flaky particles together with a compressed gas having a flow velocity of 150 m/s or more, or an injection pressure of 0.4 MPa or more onto a layer-forming surface of a workpiece so that the injected flaky particles are collided with the surface of the workpiece while spinning in a turbulent gas, and the flaky particles, which are continuously injected from an injection nozzle and subsequently reach the surface of the workpiece, collide with flaky particles having already reached the surface of the workpiece, to which the injection pressure of the compressed gas to inject the flaky particles is also applied whereby the flat surface of the flaky particle is oriented to be in line with the surface of the workpiece;

generating heat at a point of collision between the flaky particles and the surface of the workpiece, melting the workpiece and/or the flaky particle at the point of collision and fusing the flaky particles to the surface of the workpiece at a boundary portion between the workpiece and the flaky particle without melting the flaky particle completely in a condition of which the flat surface of the flaky particle is oriented to be in line with the surface of the workpiece, so that the flaky particles are exposed on the surface of the workpiece without the aid of a binder, and generating heat at a collision point in which the subsequent flaky particles collide with the flake particles that have already reached the surface of the workpiece to bond the flaky particles which are laminated, each other without the aid of the binder.

2. The method for forming the layer of the flaky particles according to claim 1, wherein:

when the flaky particles are aluminum, the injection is performed by means of the compressed gas having a flow velocity of 150 m/s to 310 m/s or an injection pressure of 0.4 MPa to 0.7 MPa with the long side forming the flat surface is 0.05 mm to 0.01 mm in length.

* * * * *

UNITED STATES PATENT AND TRADEMARK OFFICE

CERTIFICATE OF CORRECTION

PATENT NO. : 7,629,022 B2
APPLICATION NO. : 11/174317
DATED : December 8, 2009
INVENTOR(S) : Mase et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 133 days.

Signed and Sealed this

Second Day of November, 2010

David J. Kappos

David J. Kappos
*Director of the United States Patent and Trademark Office*